US009261107B2

(12) United States Patent
Kim et al.

(10) Patent No.: US 9,261,107 B2
(45) Date of Patent: Feb. 16, 2016

(54) CENTRIFUGAL FAN AND REFRIGERATOR HAVING THE SAME

(75) Inventors: Hyun Joo Kim, Gwangju (KR); Eung Ryeol Seo, Gwangju (KR); Sang Jin Lee, Gwangju (KR); Ji Hoon Choi, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 678 days.

(21) Appl. No.: 13/373,092

(22) Filed: Nov. 4, 2011

(65) Prior Publication Data

US 2012/0121422 A1 May 17, 2012

(30) Foreign Application Priority Data

Nov. 16, 2010 (KR) ..... 10-2010-0114150

(51) Int. Cl.
*F01D 5/22* (2006.01)
*F04D 29/28* (2006.01)
*F04D 29/30* (2006.01)

(52) U.S. Cl.
CPC ..... *F04D 29/281* (2013.01); *F04D 29/30* (2013.01)

(58) Field of Classification Search
CPC ..... F04D 29/281; F04D 29/282; F04D 29/30; F04D 29/2216; F04D 29/242
USPC ..... 416/185, 189, 183, 223 B
See application file for complete search history.

(56) References Cited

U.S. PATENT DOCUMENTS

| | | | | | |
|---|---|---|---|---|---|
| 3,355,907 | A * | 12/1967 | Simmons | 62/229 |
| 4,676,718 | A * | 6/1987 | Sarvanne | 415/225 |
| 7,374,394 | B2 * | 5/2008 | Lin | 415/58.4 |
| 2007/0009353 | A1 * | 1/2007 | Huang et al. | 415/206 |
| 2007/0116576 | A1 * | 5/2007 | Chang et al. | 416/228 |
| 2007/0251680 | A1 * | 11/2007 | Kinoshita | 165/145 |

* cited by examiner

*Primary Examiner* — Dwayne J White
*Assistant Examiner* — Alexander White
(74) *Attorney, Agent, or Firm* — Staas & Halsey LLP

(57) ABSTRACT

A centrifugal fan includes a main shroud and a sub shroud. The main shroud is configured to connect upper ends of outer rims of a plurality of blades spaced apart from one another in a circumferential direction of a base. The sub shroud is provided at the upper end of the outer rim of each blade and serves to prevent air from moving from a pressure surface to a negative pressure surface of each blade by passing over an upper end of the blade.

22 Claims, 8 Drawing Sheets

CENTRIFUGAL FAN AND REFRIGERATOR HAVING THE SAME

CROSS-REFERENCE TO RELATED APPLICATIONS

This application claims the benefit of Korean Patent Application No. 2010-0114150, filed on Nov. 16, 2010 in the Korean Intellectual Property Office, the disclosure of which is incorporated herein by reference.

BACKGROUND

1. Field

Embodiments relate to a centrifugal fan to increase the flow rate of air with reduced noise and a refrigerator having the same.

2. Description of the Related Art

Generally, centrifugal fans have been applied to various home electronics, such as refrigerators, air conditioners, and cooking appliances, owing to high efficiency and low noise thereof.

A conventional centrifugal fan includes a disc-shaped base having a hub to which a rotating shaft of a motor is secured, and a plurality of blades installed to the base at a right angle to guide axially introduced air in a radial direction.

In recent years, various studies have been conducted to provide the centrifugal fan with an increased flow rate of air and reduced noise.

SUMMARY

Therefore, it is an aspect to provide a centrifugal fan to increase the flow rate of air with reduced noise and a refrigerator having the same.

Additional aspects will be set forth in part in the description which follows and, in part, will be apparent from the description, or may be learned by practice of the invention.

In accordance with one aspect, a centrifugal fan includes a disc-shaped base to which a motor shaft is coupled, a plurality of blades spaced apart from one another in a circumferential direction of the base to guide axially introduced air in a circumferential direction of the base, each blade including a pressure surface to push the air, a negative pressure surface opposite to the pressure surface, a leading edge toward the motor shaft, and a trailing edge toward an outer circumference of the base, a main shroud extending in a radial outward direction of the base from a circumscribed circle defined by connecting upper ends of the trailing edges of the plurality of blades, and a sub shroud to prevent the air from moving from the pressure surface to the negative pressure surface by passing over an upper end of the trailing edge of each blade.

The sub shroud may extend forward of the pressure surface from a position where each of the plurality of blades comes into contact with the main shroud.

The sub shroud may include a contact point where the trailing edge comes into contact with an inner-diameter portion of the main shroud, a first portion extending from the contact point along an upper end of the pressure surface, and a second portion extending from the contact point along the inner-diameter portion of the main shroud.

A radial width of the main shroud may be in a range of about 4% to about 6% of a diameter of the base.

A straight length of the first portion may be in a range of about 11% to about 17% of a chord length that is a straight distance between the leading edge and the trailing edge, and a straight length of the second portion may be in a range of about 35% to about 45% of a straight distance between the trailing edge of any one of the plurality of blades and the trailing edge of another adjacent blade.

The main shroud and the sub shroud may take the form of horizontally extending flat plates having substantially the same thickness.

The sub shroud may include a third portion facing the first portion and a fourth portion facing the second portion, and a first stagger angle between the third portion and an imaginary line connecting a contact point where the third portion comes into contact with the inner-diameter portion of the main shroud to an axial center of the base may be in a range of about +5° to about −10° of a second stagger angle between the chord length between the leading edge and the trailing edge and an imaginary line connecting the axial center of the base to the trailing edge.

The centrifugal fan may be integrally formed by injection molding.

In accordance with another aspect, a refrigerator includes a centrifugal fan having any one of the above-described features, the centrifugal fan being installed to a rear wall of a storage compartment of the refrigerator to blow cold air fed from an evaporator into the storage compartment.

In accordance with another aspect, a centrifugal fan, including a disc-shaped base, a plurality of blades radially arranged about an axial center of the base, each blade including a pressure surface, a negative pressure surface, a leading edge and a trailing edge, a main shroud connecting upper ends of the trailing edges of the blades, and a sub shroud to cover a corner of the pressure surface where each of the plurality of blades comes into contact with the main shroud, so as to prevent generation of a turbulent flow moving from the pressure surface to the negative pressure surface.

The trailing edge may correspond to an outer circumference of the base, and the main shroud may extend from an upper end of the trailing edge so as to protrude outward from the outer circumference of the base.

The sub shroud may take the form of a rectangular plate including a contact point where the trailing edge comes into contact with an inner-diameter portion of the main shroud, a first portion extending from the contact point along an upper end of the pressure surface, a second portion extending from the contact point along the inner-diameter portion of the main shroud, a third portion facing the first portion, and a fourth portion facing the second portion.

A radial width of the main shroud may be in a range of about 4% to about 6% of a diameter of the base.

A straight length of the first portion may be in a range of about 11% to about 17% of a chord length of each blade, and a straight length of the second portion may be in a range of about 35% to about 45% of a straight distance between the trailing edge of any one of the plurality of blades and the trailing edge of another adjacent blade.

A stagger angle of the sub shroud may be in a range of about +5° to about −10° of a stagger angle of the blade.

In accordance with a further aspect, a centrifugal fan includes a disc-shaped base, a plurality of blades radially arranged about an axial center of the base, each blade including a pressure surface, a negative pressure surface, a leading edge and a trailing edge, and a main shroud connecting upper ends of the trailing edges of the blades, wherein the main shroud takes the form of a flat plate having an inner-diameter portion connecting upper ends of the trailing edges and an outer-diameter portion protruding outward from the base.

A radial width of the main shroud may be in a range of about 4% to about 6% of a diameter of the base.

The centrifugal fan may further include a sub shroud in the form of a flat plate extending forward of the pressure surface from a corner of the pressure surface where the trailing edge comes into contact with the inner-diameter portion.

The main shroud and the sub shroud may have substantially the same thickness.

A lower surface of the main shroud and a lower surface of the sub shroud may be arranged on the same plane.

The base may be provided at a portion thereof facing the sub shroud with a cut-out having a shape corresponding to the sub shroud, and the centrifugal fan may be integrally formed by injection molding.

The sub shroud may include a first portion extending from a contact point where the trailing edge comes into contact with the inner-diameter portion along an upper end of the blade, a second portion extending from the contact point along the inner-diameter portion, a third portion facing the first portion and a fourth portion facing the second portion, a straight length of the first portion may be in a range of about 11% to about 17% of a chord length that is a straight distance between the leading edge and the trailing edge, and a straight length of the second portion may be in a range of about 35% to about 45% of a straight distance between the trailing edge of any one of the plurality of blades and the trailing edge of another adjacent blade.

A stagger angle of the sub shroud may be in a range of about +5° to about −10° of a stagger angle of the blade.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
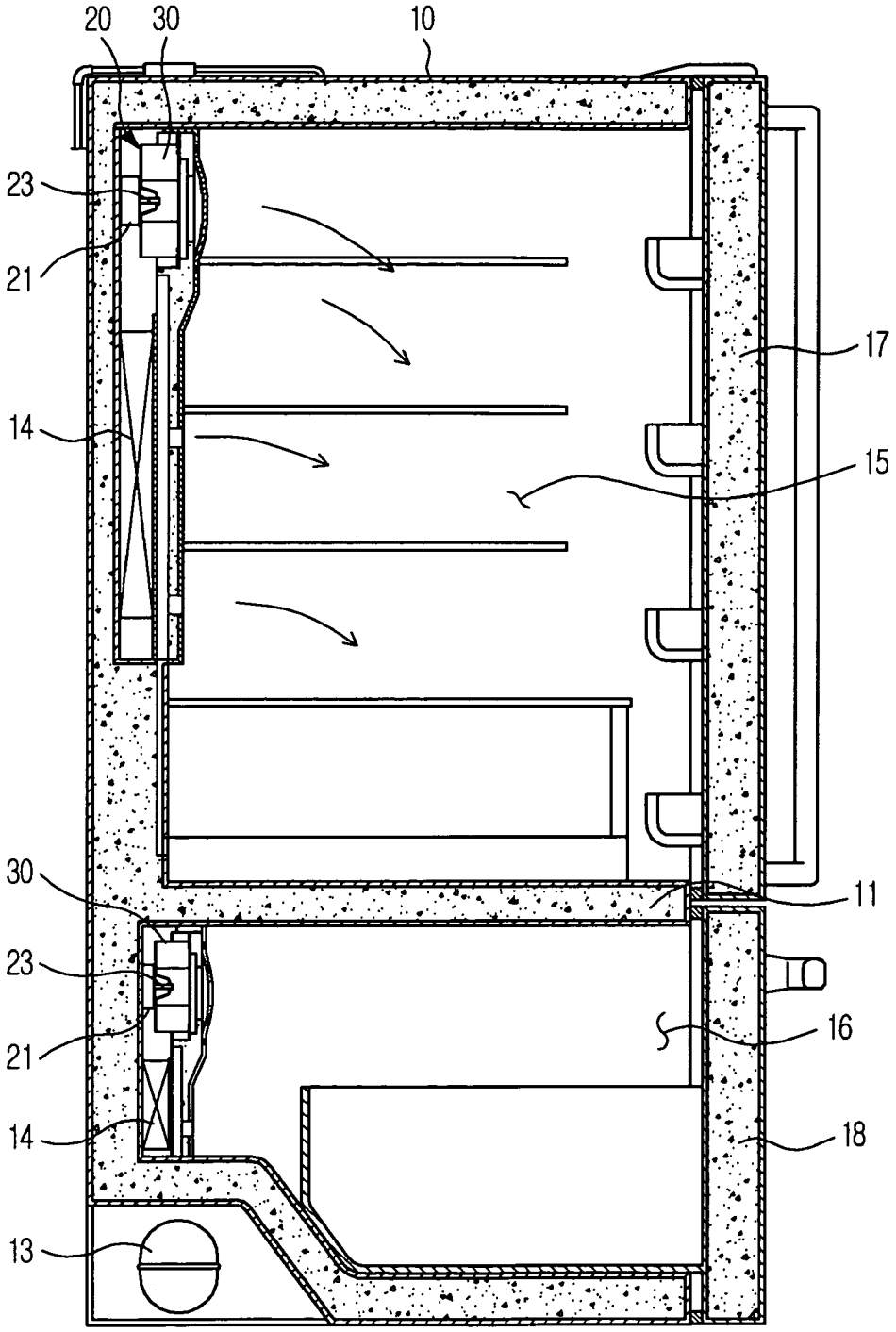
FIG. 1 is a schematic sectional view of a refrigerator according to an embodiment.

Reference will now be made in detail to a centrifugal fan and a refrigerator having the same according to the embodiments, examples of which are illustrated in the accompanying drawings, wherein like reference numerals refer to like elements throughout.

FIG. 1 is a schematic sectional view of a refrigerator according to an embodiment.

Referring to FIG. 1, the refrigerator according to the embodiment includes a main body 10 having storage compartments 15 and 16 vertically separated from each other by an insulating partition 11, doors 17 and 18 provided at the front side of the respective storage compartments 15 and 16 to open or close the storage compartments 15 and 16, and a blowing device 20 provided at a rear wall of the storage compartments 15 and 16 to blow cold air into the storage compartments 15 and 16.

The refrigerator according to the embodiment may include constituent components of a refrigeration cycle including a compressor 13, a condenser (not shown), an expander (not shown) and an evaporator 14.

The storage compartments 15 and 16 may include an upper refrigerating compartment 15 and a lower freezing compartment 16. The doors 17 and 18 may include a pair of rotatable doors 17 to open or close the refrigerating compartment 15, and a drawer type door 18 to open or close the freezing compartment 16.

The blowing device 20, provided at the rear wall of the storage compartments 15 and 16, serves to blow cold air generated by the evaporator 14 into the storage compartments 15 and 16.

The blowing device 20 may include a centrifugal fan 30 installed on a cold-air flow-path to blow cold air produced by the evaporator 14 and a motor 21 serving as a drive device to rotate the centrifugal fan 30.

Figure 2:
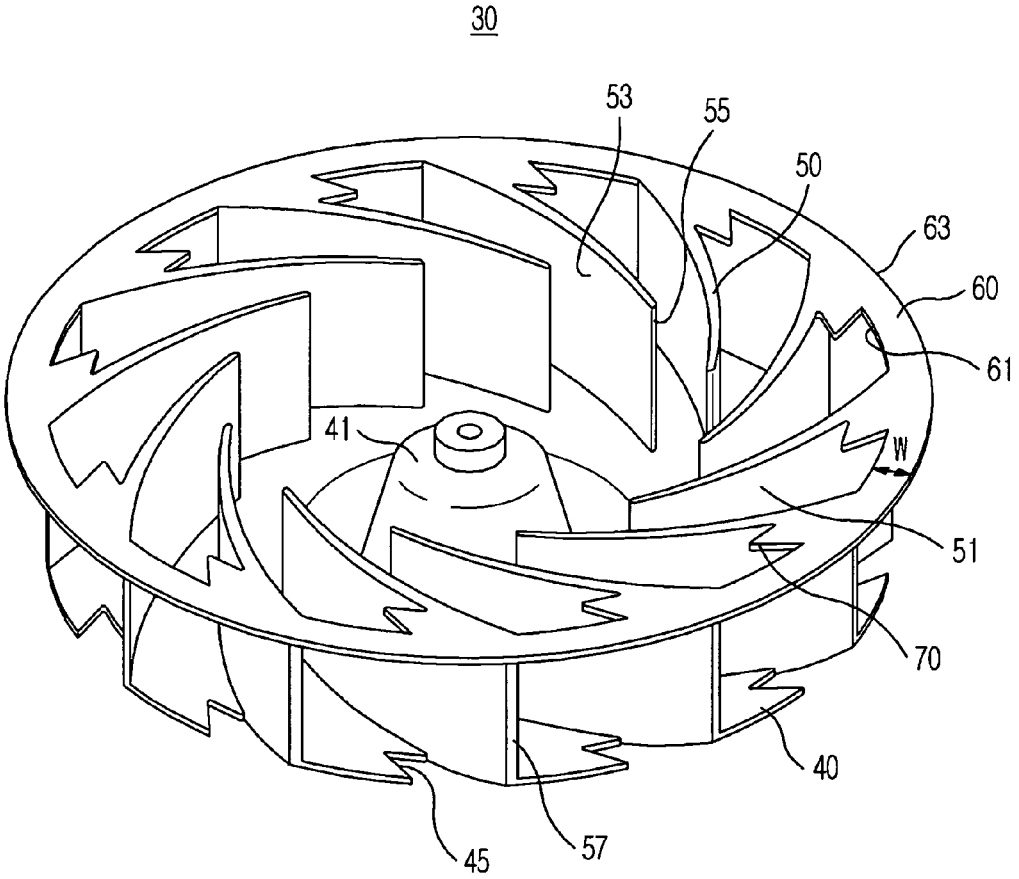
FIG. 2 is a perspective view illustrating a centrifugal fan according to an embodiment.
Figure 3:
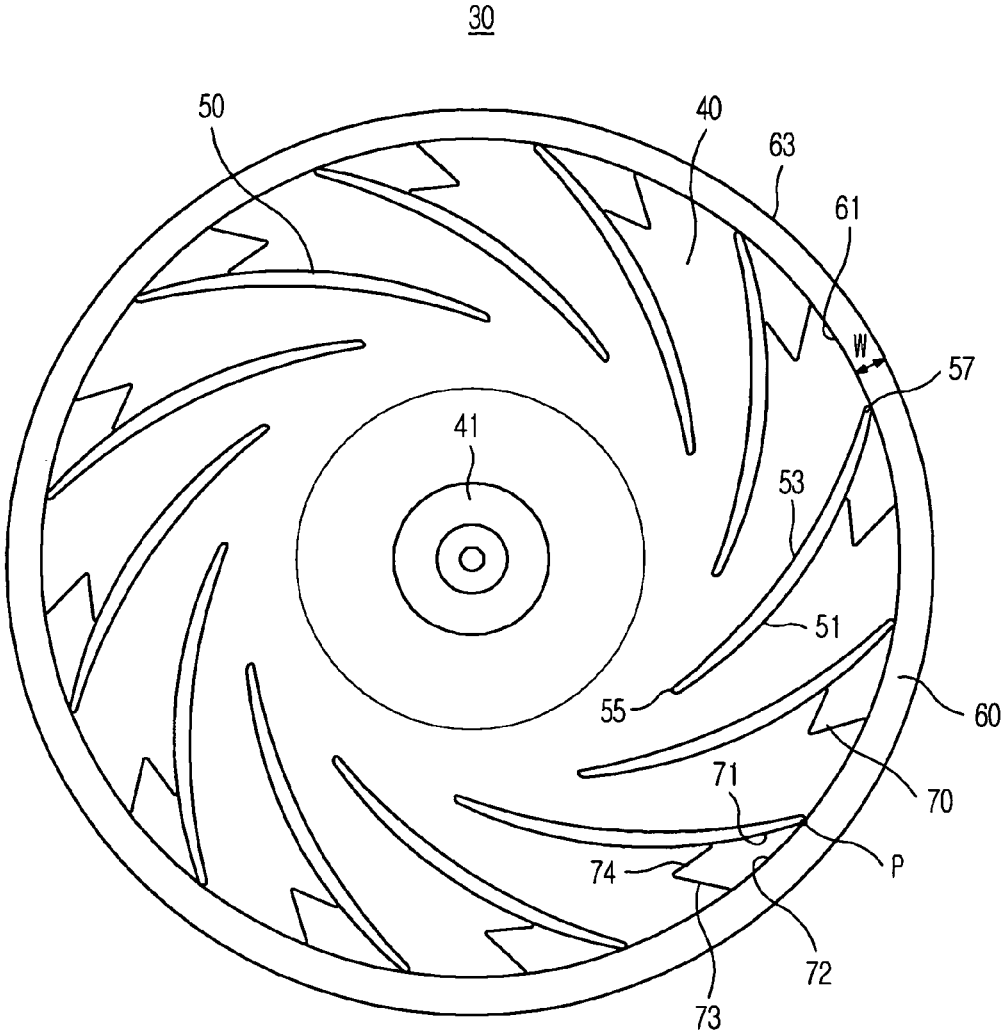
FIG. 3 is a plan view of the centrifugal fan according to the embodiment.
Figure 4:
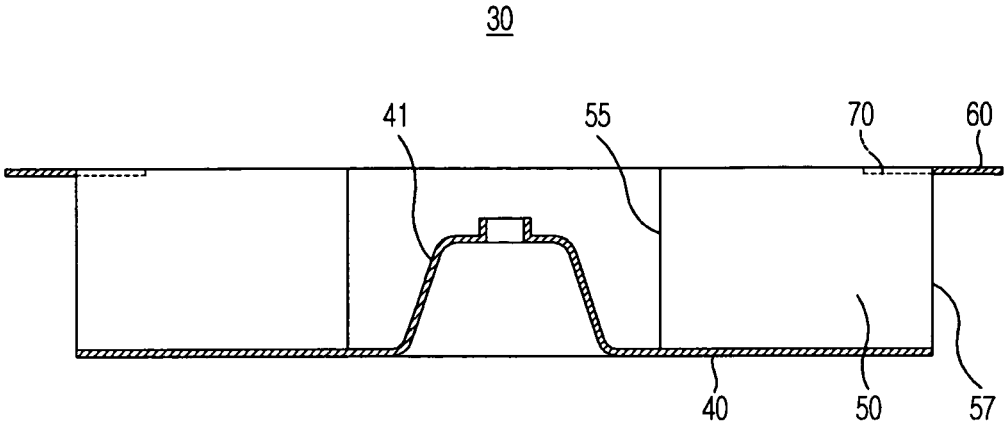
FIG. 4 is a sectional view of the centrifugal fan according to the embodiment.

FIG. 2 is a perspective view illustrating the centrifugal fan according to an embodiment, FIG. 3 is a plan view of the centrifugal fan according to the embodiment, and FIG. 4 is a sectional view of the centrifugal fan according to the embodiment.

Referring to FIGS. 2 to 4, the centrifugal fan 30 may include a disc-shaped base 40, to which a motor shaft 23 is coupled, a plurality of blades 50 to guide axially introduced air in a radial direction of the base 40, and a main shroud 60 to prevent air from eddying at an exit of the plurality of blades 50.

The base 40 is centrally provided with an upwardly protruding hub 41 such that the motor shaft 23 is secured to the motor shaft 23. The plurality of blades 50 is arranged at an edge of the base 40 so as to be spaced apart from one another by a constant distance in a circumferential direction of the base 40.

The main shroud 60 is arranged opposite to the base 40 and may take the form of an annular plate having a predetermined width W. The main shroud 60 includes an inner-diameter portion 61 connecting upper ends of outer rims of the plurality of blades 50, and an outer-diameter portion 63 extending from the inner-diameter portion 61 outward of the base 40.

The outer rims of the plurality of blades 50 correspond to an outer rim of the base 40. The main shroud 60, as illustrated in FIG. 4, may horizontally extend from the upper ends of the outer rims of the plurality of blades 50 in a radial outward direction of the base 40 to have a predetermined width W.

The main shroud 60 serves to guide flow of air at the exit of the blades 50, thereby reducing noise caused when an eddy occurs above the exit of the blades 50.

In addition, the main shroud 60 extends outward so as not to overlap with the base 40, which prevents reduction in the flow rate of air introduced in an axial direction of the base 40.

Specifically, when the main shroud 60 extends inward of the base 40 from the upper ends of the outer rims of the plurality of blades 50, the area of the base 40 is reduced in proportion to an extension width of the main shroud 60, which increases the flow resistance of axially introduced air and reduces the flow rate of air. On the other hand, since the main shroud 60 of the present embodiment extends outward of the base 40, the resulting centrifugal fan exhibits less loss in the flow rate of air than a fan having the same dimensions.

In this way, during rotation of the centrifugal fan 30, the blades 50 act to allow air introduced in an axial direction of the base 40 into gaps between the blades 50 to be discharged in a circumferential direction of the base 40 and the main shroud 60 further guides the air discharged from distal ends of the plurality of blades 50 to prevent generation of an eddy, which reduces noise due to generation of an eddy and increases the flow rate of air.

Each of the plurality of blades 50 includes a pressure surface 51 to push air, and a negative pressure surface 53 opposite to the pressure surface 51, at which pressure of air is lower than atmospheric pressure.

Each of the plurality of blades 50 may further include a leading edge 55 coming into contact with the air introduced in the axial direction of the base 40 and a trailing edge 57 located at an outer circumference of the base 40, from which the air is discharged.

In the present embodiment, the trailing edge 57, as illustrated in FIG. 4, may correspond to the outer circumference of the base 40.

Figure 5:
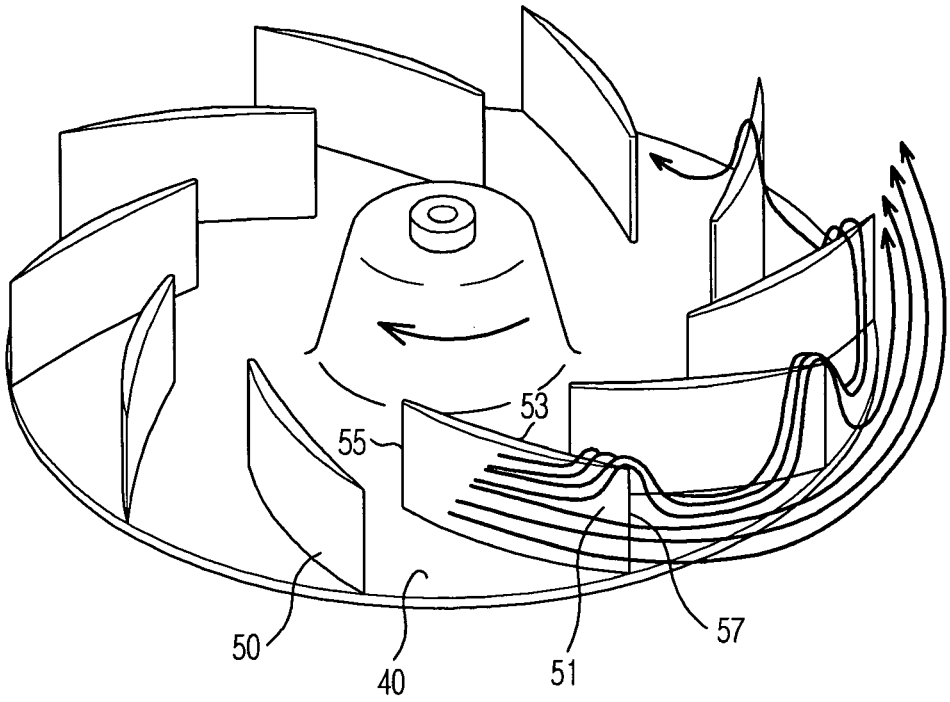
FIG. 5 is a view illustrating the flow pattern of air in a centrifugal fan having no main shroud and sub shroud according to the embodiment.

Although the centrifugal fan 30 of the present embodiment reduces noise because the main shroud 60 guides the air discharged from the exit of the blades 50 to prevent generation of an eddy, as illustrated in FIG. 5, a part of the air is liable to move from the upper ends of the blades 50 to a low-pressure space toward the negative pressure surface 53 rather than being discharged to the exit of the blades 50.

To prevent the above-described unintentional movement of air, the centrifugal fan 30 of the present embodiment may further include a sub shroud 70 provided at a contact region between each of the plurality of blades 50 and the main shroud 60.

The sub shroud 70 may horizontally extend to have a predetermined area from a corner where the pressure surface 51 of each blade 50 comes into contact with the inner-diameter portion 61 of the main shroud 60.

The sub shroud 70 may take the form of a rectangular plate having first to fourth portions 71 to 74. The first portion 71 extends along an upper end of the pressure surface 51 from a contact point P of the pressure surface 51 where the trailing edge 57 comes into contact with the inner-diameter portion 61 of the main shroud 60. The second portion 72 extends from the contact point P along the inner-diameter portion 61 of the main shroud 60. The third and fourth portions 73 and 74 are arranged respectively to face the first and second portions 71 and 72.

The sub shroud 70 may have substantially the same thickness as that of the main shroud 70. Specifically, upper and lower surfaces of the sub shroud 70 may be connected respectively to upper and lower surfaces of the main shroud 60 so as to be arranged on substantially the same plane as each other without stepped portions.

With the above-described configuration, when the air introduced in the axial direction of the base 40 is discharged from the trailing edge 57 by way of the pressure surface 51 of the blade 50, the sub shroud 70 serves to prevent generation of an eddy caused when a part of the air near the trailing edge 57 moves from the pressure surface 51 to the negative pressure surface 53 by passing over the upper end of the blade 50.

Specifically, referring to FIG. 5 illustrating a case in which the main shroud 60 and the sub shroud 70 of the present embodiment are not provided, a part of air present at the pressure surface 51 of the blade 50 may move from an upper end of the trailing edge 57 of the blade 50 to the low-pressure space toward the negative pressure surface 53 of the blade 50, rather than being discharged to the exit of the centrifugal fan 30. The resulting strong turbulent flow of air between the respective blades 50 increases noise.

Furthermore, since the air generated by the plurality of blades 50 is not discharged to the exit of the centrifugal fan 30, reduction in the flow rate of air may occur.

Figure 6:
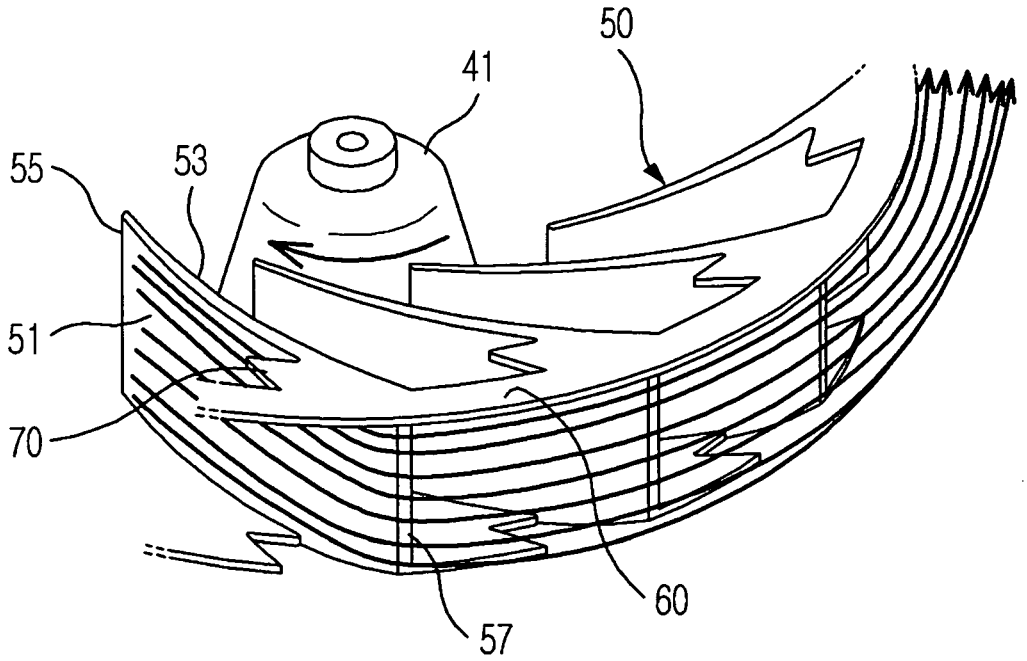
FIG. 6 is a view illustrating the flow pattern of air in the centrifugal fan according to the embodiment.

On the other hand, in the case of the centrifugal fan 30 having the main shroud 60 and the sub shroud 70 according to the present embodiment, as illustrated in FIG. 6, during rotation of the centrifugal fan 30, the air passing through between the blades 50 is discharged to the exit of the centrifugal fan 30 substantially without a risk of generating an eddy, which results in an increased flow rate of air with reduction of noise due to generation of an eddy.

In this way, the centrifugal fan 30 of the present embodiment may be smaller than the centrifugal fan 30 that exhibits the same level of flow rate and noise generation. Installing the centrifugal fan 30 to a flow path of an electronic product has the effect of realizing a slim product.

In the centrifugal fan 30 of the present embodiment, the main shroud 60, the sub shroud 70, the blade 50 and the base 40 may be integrally formed by injection molding. The base 40 may be provided at a portion thereof facing the sub shroud 70 with a cut-out 45 having a shape corresponding to the sub shroud 70. This serves to enable easy separation of the centrifugal fan 30 to which the main shroud 60 and the sub shroud 70 are integrally formed after completion of injection molding.

Hereinafter, several design factors of the centrifugal fan 30 of the present embodiment will be described.

Figure 7:
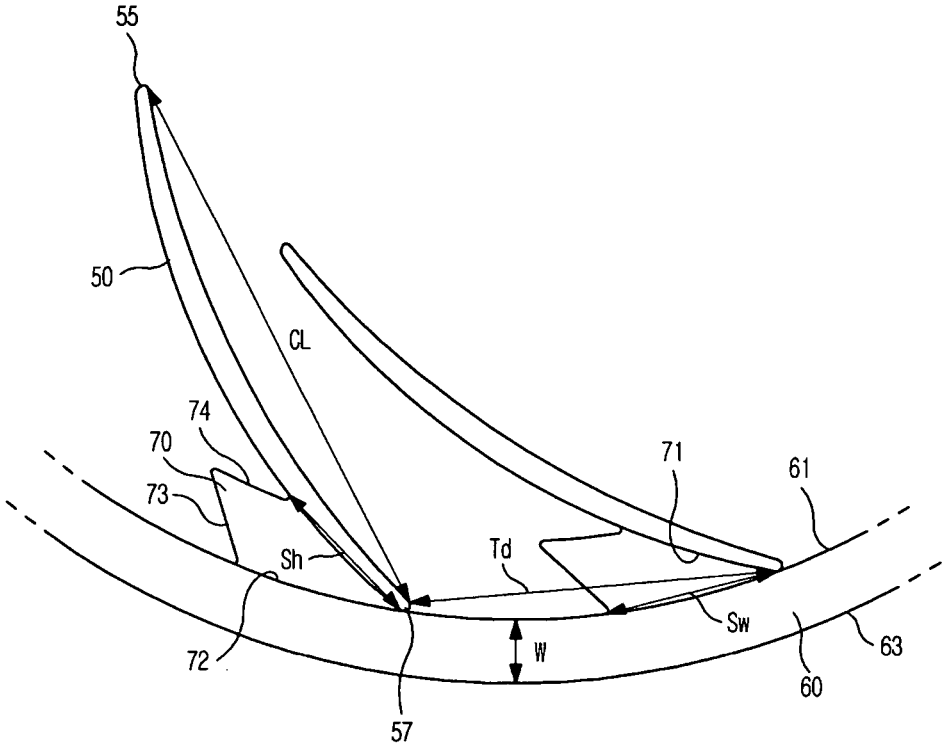
FIGS. 7 and 8 are views illustrating several design factors of the centrifugal fan according to the embodiment.
Figure 8:
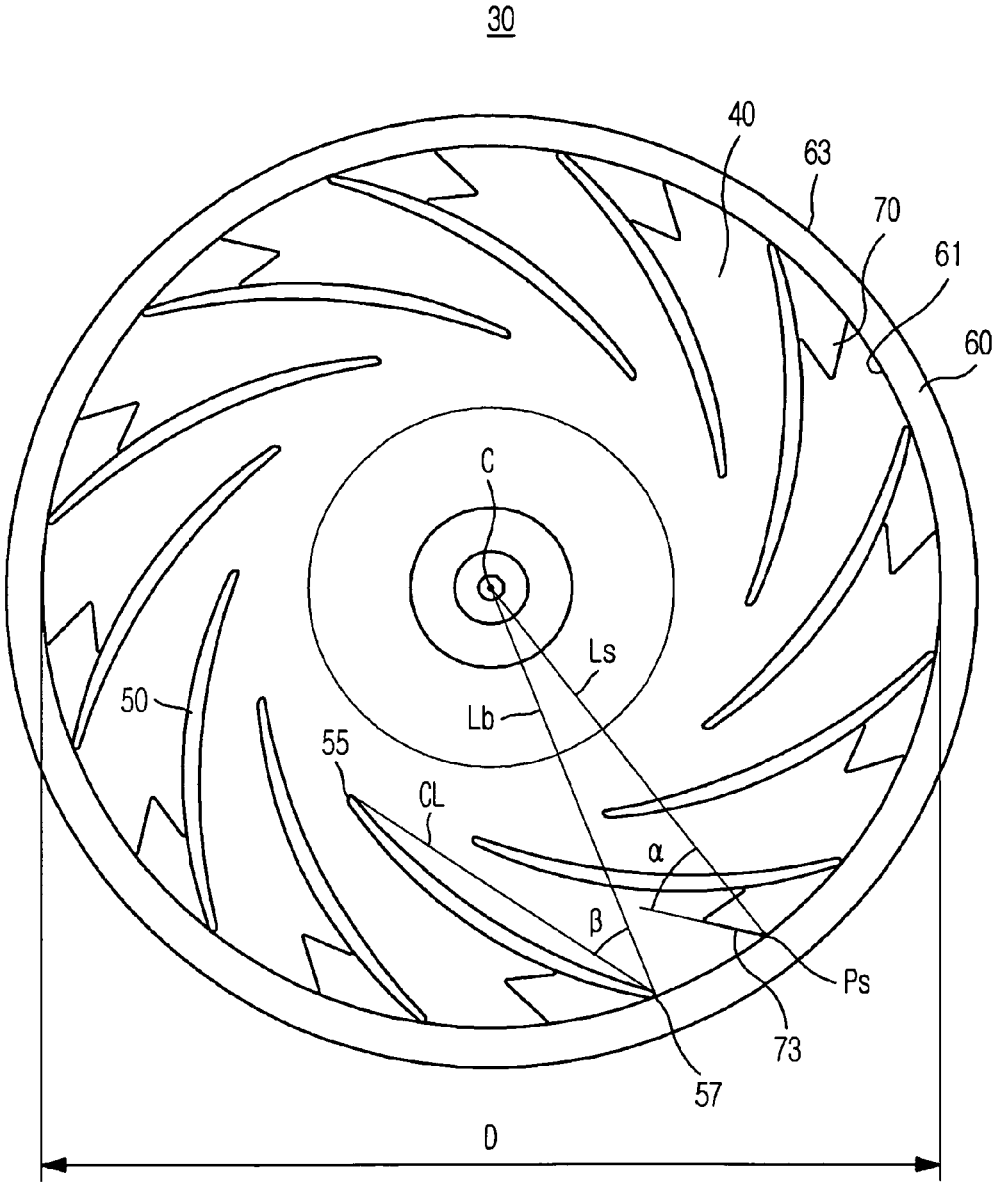

FIGS. 7 and 8 are views illustrating a relationship between the blade, the main shroud and the sub shroud according to the embodiment of the present invention.

Referring to FIGS. 7 and 8, a radial width W of the main shroud 60 may be 4~6% of a diameter D of the base 40. With this configuration, the main shroud 60 is configured to cover only an eddy generating region of the base 40 near the outer rim of the blade 50, which maximizes air flow guiding effects and prevents the main shroud 60 from being unnecessarily large.

In addition, a straight length Sh of the first portion 71 of the sub shroud 70 may be 11~17% of a chord length CL which is a straight distance between the leading edge 55 and the trailing edge 57 of the blade 50. A straight length Sw of the second portion 72 may be 35~45% of a straight distance Td between the trailing edges 57 of the adjacent blades 50.

When the main shroud 60 and the sub shroud 70 are within the above-described numerical range, benefits obtained by preventing generation of an eddy and increasing the available flow rate of air are greater than loss caused when the flow rate of air is reduced in proportion to the area occupied by the sub shroud 70.

A first stagger angle $\alpha$ (i.e. a stagger angle of the sub shroud) between the third portion 73 and an imaginary line Ls, which connects a contact point Ps where the third portion 73 comes into contact with the inner-diameter portion 61 of the main shroud 60 to an axial center C of the base 40, may be in a range of +5° to −10° of a second stagger angle $\beta$ (a stagger angle of the blade) between the chord length CL and an imaginary line Lb which connects the axial center C of the base 40 to the trailing edge 57. This serves to provide the sub shroud 70 with a shape corresponding to the blade 50, thereby preventing generation of noise owing to air flow guiding effects of the sub shroud 70. If the second stagger angle $\beta$ of the sub shroud 70 is outside the above numerical range, noise of the centrifugal fan 30 increases.

The centrifugal fan 30 having the above-described configuration may achieve reduced noise and an increased flow rate of air as compared to conventional centrifugal fans.

The following table diagrammatically represents comparative experimental results of the centrifugal fan according to the embodiment and a conventional centrifugal fan.

TABLE 1

| Option | Flow Rate | Flow Rate Change | Noise |
|---|---|---|---|
| Conventional fan | 0.77 CMM | Reference | 41.5 dBA |
| Main shroud | 0.81 CMM | +5.2% | 40.5 dBA |
| Main shroud + Sub shroud | 0.86 CMM | +10.9% | 40.5 dBA |

As will be appreciated from Table 1, the centrifugal fan 30 having the main shroud 60 of the present embodiment is increased in the flow rate of air by about 5.2% and is reduced in noise by about 1 dB as compared to the conventional centrifugal fan.

In addition, it will be appreciated that the centrifugal fan 30 having both the main shroud 60 and the sub shroud 70 of the present embodiment is increased in the flow rate of air by about 10.9% and is reduced in noise by about 1 dB as compared to the conventional centrifugal fan.

As is apparent from the above description, a centrifugal fan and a refrigerator having the same according to the embodiment may prevent a separate flow near an exit of the fan, resulting in an increased flow rate of air and reduced noise.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A centrifugal fan comprising:

a disc-shaped base to which a motor shaft is coupled;

a plurality of blades spaced apart from one another in a circumferential direction of the base to guide axially introduced air in a circumferential direction of the base, each blade including a pressure surface to push the air, a negative pressure surface opposite to the pressure surface, a leading edge toward the motor shaft, and a trailing edge toward an outer circumference of the base;

a main shroud extending in a radial outward direction of the base from a circumscribed circle defined by connecting upper ends of the trailing edges of the plurality of blades; and a sub shroud extending forward of the pressure surface from a position where each of the plurality of blades comes into contact with the main shroud and serving to prevent the air from moving from the pressure surface to the negative pressure surface by passing over an upper end of the trailing edge of each blade, wherein the sub shroud horizontally extends to form a protruding corner having a predetermined area formed from where the pressure surface of each blade comes into contact with an inner-diameter portion of the main shroud, the base is provided with a cut-out from an outer circumference of the base extending radially inward, and the cut-out extends through the outer circumference of the base.

2. The centrifugal fan according to claim 1, wherein the sub shroud includes a contact point where the trailing edge comes into contact with the inner-diameter portion of the main shroud, a first portion extending from the contact point along an upper end of the pressure surface, and a second portion extending from the contact point along the inner-diameter portion of the main shroud.

3. The centrifugal fan according to claim 2, wherein a radial width of the main shroud is in a range of about 4% to about 6% of a diameter of the base.

4. The centrifugal fan according to claim 2, wherein:

a straight length of the first portion is in a range of about 11% to about 17% of a chord length that is a straight distance between the leading edge and the trailing edge; and a straight length of the second portion is in a range of about 35% to about 45% of a straight distance between the trailing edge of any one of the plurality of blades and the trailing edge of another adjacent blade.

5. The centrifugal fan according to claim 4, wherein the main shroud and the sub shroud comprise horizontally extending flat plates having substantially the same thickness.

6. The centrifugal fan according to claim 5, wherein:

the sub shroud includes a third portion facing the first portion and a fourth portion facing the second portion; and a first stagger angle between the third portion and an imaginary line connecting a contact point where the third portion comes into contact with the inner-diameter portion of the main shroud to an axial center of the base is in a range of about +5° to about −10° of a second stagger angle between the chord length between the leading edge and the trailing edge and an imaginary line connecting the axial center of the base to the trailing edge.

7. The centrifugal fan according to claim 6, wherein the centrifugal fan is integrally formed by injection molding.

8. A refrigerator comprising:

a centrifugal fan according to claim 1, the centrifugal fan being installed to a rear wall of a storage compartment of the refrigerator to blow cold air fed from an evaporator into the storage compartment.

9. A centrifugal fan comprising:

a disc-shaped base;

a plurality of blades radially arranged about an axial center of the base, each blade including a pressure surface, a negative pressure surface, a leading edge and a trailing edge, and a main shroud connecting upper ends of the trailing edges of the blades; and a sub shroud to cover a corner of the pressure surface where each of the plurality of blades comes into contact with the main shroud, so as to prevent generation of a turbulent flow moving from the pressure surface to the negative pressure surface, wherein the sub shroud horizontally extends to form a protruding corner having a predetermined area formed from where the pressure surface of each blade comes into contact with an inner-diameter portion of the main shroud, and the base is provided with a cut-out from an outer circumference of the base extending radially inward, and the cut-out extends through the outer circumference of the base.

10. The centrifugal fan according to claim 9, wherein the trailing edge corresponds to an outer circumference of the base, and the main shroud extends from an upper end of the trailing edge so as to protrude outward from the outer circumference of the base.

11. The centrifugal fan according to claim 10, wherein the sub shroud takes the form of a rectangular plate including a contact point where the trailing edge comes into contact with the inner-diameter portion of the main shroud, a first portion extending from the contact point along an upper end of the pressure surface, a second portion extending from the contact point along the inner-diameter portion of the main shroud, a third portion facing the first portion, and a fourth portion facing the second portion.

12. The centrifugal fan according to claim 11, wherein a radial width of the main shroud is in a range of about 4% to about 6% of a diameter of the base.

13. The centrifugal fan according to claim 11, wherein:

a straight length of the first portion is in a range of about 11% to about 17% of a chord length of each blade; and a straight length of the second portion is in a range of about 35% to about 45% of a straight distance between the trailing edge of any one of the plurality of blades and the trailing edge of another adjacent blade.

14. The centrifugal fan according to claim 13, wherein a stagger angle of the sub shroud is in a range of about +5° to about −10° of a stagger angle of the blade.

15. A centrifugal fan comprising:

a disc-shaped base; and a plurality of blades radially arranged about an axial center of the base, each blade including a pressure surface, a negative pressure surface, a leading edge and a trailing edge, a main shroud connecting upper ends of the trailing edges of the blades, and a sub shroud extending forward of the pressure surface from a position where each of the plurality of blades comes into contact with the main shroud and serving to prevent the air from moving from the pressure surface to the negative pressure surface by passing over an upper end of the trailing edge of each blade, wherein the main shroud comprises a flat plate having an inner-diameter portion connecting upper ends of the trailing edges and an outer-diameter portion protruding outward from the base, wherein the sub shroud horizontally extends to form a protruding corner having a predetermined area formed from where the pressure surface of each blade comes into contact with the inner-diameter portion of the main shroud, wherein the base is provided with a cut-out from an outer circumference of the base extending radially inward, and wherein the cut-out extends through the outer circumference of the base.

16. The centrifugal fan according to claim 15, wherein a radial width of the main shroud is in a range of about 4% to about 6% of a diameter of the base.

17. The centrifugal fan according to claim 16, wherein the sub shroud includes a flat plate extending forward of the pressure surface from the corner of the pressure surface where the trailing edge comes into contact with the inner-diameter portion.

18. The centrifugal fan according to claim 17, wherein the main shroud and the sub shroud have substantially the same thickness.

19. The centrifugal fan according to claim 17, wherein a lower surface of the main shroud and a lower surface of the sub shroud are arranged on the same plane.

20. The centrifugal fan according to claim 19, wherein:

the sub shroud includes a first portion extending from a contact point where the trailing edge comes into contact with the inner-diameter portion along an upper end of the blade, a second portion extending from the contact point along the inner-diameter portion, a third portion facing the first portion and a fourth portion facing the second portion;

a straight length of the first portion is in a range of about 11% to about 17% of a chord length that is a straight distance between the leading edge and the trailing edge; and a straight length of the second portion is in a range of about 35% to about 45% of a straight distance between the trailing edge of any one of the plurality of blades and the trailing edge of another adjacent blade.

21. The centrifugal fan according to claim 20, wherein a stagger angle of the sub shroud is in a range of about +5° to about −10° of a stagger angle of the blade.

22. The centrifugal fan according to claim 17, wherein:

the cut-out provided on the base is provided at a portion of the base facing the sub shroud with the cut-out having a shape corresponding to the sub shroud; and the centrifugal fan is integrally formed by injection molding.

* * * * *